United States Patent [19]

Masuda

[11] 4,352,235

[45] Oct. 5, 1982

[54] METHOD OF PRODUCING A DECORATIVE, CYLINDRICAL, COATED ARTICLE

[76] Inventor: Kazuo Masuda, 52-1, Saiwaicho 4 chome, Tachikawashi, Tokyo, Japan

[21] Appl. No.: 187,047

[22] Filed: Sep. 15, 1980

[30] Foreign Application Priority Data

Dec. 28, 1979 [JP] Japan ..... 54-170370

[51] Int. Cl.[3] ..... B21B 1/46

[52] U.S. Cl. ..... 29/527.4

[58] Field of Search ..... 29/527.4, 527.3, 527.2, 29/527.1

[56] References Cited

U.S. PATENT DOCUMENTS 3,295,198 1/1967 Coan ..... 29/527.4

FOREIGN PATENT DOCUMENTS 52-17528 2/1977 Japan .

52-987508 8/1977 Japan .

*Primary Examiner*—Francis S. Husar

*Assistant Examiner*—V. K. Rising

*Attorney, Agent, or Firm*—Armstrong, Nikaido, Marmelstein & Kubovcik

[57] ABSTRACT

Flanges are formed on each end of a metal cylindrical base member. The surface of the base member is roughened and a colored epoxy resin is applied to the rough surface as the base is rotated. After drying and curing the resin is shaved down to the height of the flanges and the article is polished. A plurality of different colored resins may be applied in order to give a marbled appearance and the surfaces of the flanges may be coated with a metal by an electroplating process.

9 Claims, 6 Drawing Figures

METHOD OF PRODUCING A DECORATIVE, CYLINDRICAL, COATED ARTICLE

BACKGROUND OF THE INVENTION

1. Field of the Invention

This invention relates to the field of methods for producing decorative articles. More particularly, this invention relates to the field of methods for producing decorative, cylindrical articles having a hard wear resistant coating closely adhered to the surface of a base cylinder.

2. Description of the Prior Art

Different types of polymer molding methods have been utilized in order to produce cylindrical articles such as caps for fountain pens and containers for toilet goods. For example, injection molding methods and blow-molding techniques have been utilized in order to produce such articles. However, when utilizing such methods, it is often difficult, or impossible, to produce an article which is comprised of a metal base having an outer polymer coating or an article which includes a plurality of different colored polymers applied in a decorative manner on its outer surface. Prior art methods include the production of articles which have decorative coatings which may be easily peeled from the surface of the base, since the decorative coating is not securely adhered to a base having a particular texture and shape and since any coloring is contained on the coating and not embedded within it.

SUMMARY OF THE INVENTION

The disclosed method involves a method for producing cylindrical articles which might be used, for example, as caps for fountain pens or containers for toilet goods. The articles produced by the disclosed method are highly decorative and durable due to the texture and shape of the base material, the type of coating and its method of application, and the particular shape of the finished decorative article, as well as other features of the disclosed method.

A cylindrical base member is obtained which is preferably comprised of a metal material. Flange portions are formed at either end of the base member which extend outward from the surface of the cylindrical base member. A granular material is then sprayed against the surface of the cylindrical base member in order to create a large number of concave and convex portions on the surface, roughening it. Disc members are then placed at each end of the cylinder and the disc members are held between two rotating power sources. The base is then rotated while an epoxy resin is applied to the roughened surface. The epoxy resin contains a coloring pigment and may also contain a powdered metal or shell material such a powdered pearl material. One or more different colored epoxy resins may be simultaneously applied to the roughened surface. The resin is applied so that it covers the entire roughened surface and bulges outward from the surface beyond the outer extent of the flanged portions at either end of the cylinder. The epoxy resin may then be heated to a temperature between 23° C. and 37° C. Rotation is then continued and the epoxy resin is allowed to stabilize and return to room temperature. It is also possible to continue rotation of the coated base while maintaining its temperature below 30° C. and subjecting it to a vacuum in order to defoam the epoxy resin.

After the epoxy resin has stabilized, it is cured by heating it to a temperature between 50° C. and 120° C. After the resin is dried, the article may be placed within a device such as a lathe in order to shave off the outer portions of the hardened resin material which extend outward from the base material beyond the outer extent of the flanged portions. The shayed article is then polished. If desired, the polished article may be placed within an electroplating bath in order to plate a thin layer of a desired metal onto the outer surfaces of the flanged portions. It is also possible to eccentrically rotate the cylindrical base member during the process.

It is the primary object of this invention to disclose a method for producing a decorative article comprising the steps of: (1) forming flange portions on a cylindrical base member; (2) roughening the surface of the cylindrical base member; (3) rotating the cylindrical member axially; (4) applying one or more colored epoxy resins to the roughened surface of the base member; (5) allowing for stabilization and curing of the epoxy coating; (6) shaving away excess epoxy coating from the surface of the article; and (7) polishing the resulting shaved outer surface of the article.

Another object of this invention is to disclose a method for producing an article which is highly decorative and durable and may be used for such purposes as a cap for a fountain pen or a container for toilet goods.

Another object of this invention is to produce a method for making an article which is durable due to the use of epoxy resins having pigments embedded therein.

Still another object of the invention is to disclose a method which allows for the production of an article which has a smooth final outer surface which prevents the chipping away of the applied coating.

A further object of the invention is to disclose a method which allows for the production of an article which may have both a metallic and a pigment-colored surface wherein the pigmented surface may contain a variety of different colors in a variety of patterns, such as a marble-like pattern.

These together with other objects and advantages will be apparent to those skilled in the art upon reading this disclosure in connection with the attached drawings.

DETAILED DESCRIPTION OF PREFERRED EMBODIMENTS

It is to be understood that variations and modifications of the below-described methods will occur to those of ordinary skill in the art upon reading the description and seeing the attached drawings. Therefore, the inventive methods disclosed by the applicant here should not be interpreted as being limited to the precise description of the methods set forth herein, since the scope of their invention is only to be limited by the attached claims.

Figure 1:
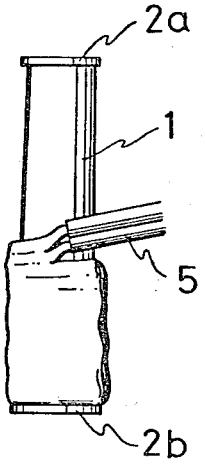
FIG. 1 is a front elevational view showing a partially coated cylindrical base member during a coating process.

Referring now to the drawings and in particular to FIG. 1 showing the cylindrical base member 1, having flanged portions 2*a* and 2*b*. In order to carry out any of the particular embodiments of the invention disclosed herein, it is necessary to obtain a cylindrical base member such as the base member 1, which is preferably comprised of a metal material. Flanged portions 2*a* and 2*b* are formed at either end of the base 1 in such a manner that they extend outwardly from the surface of the base 1 in order to form an outer lip surface at each end of the cylinder.

After the flanges 2*a* and 2*b* have been formed on the base member 1, the surface of the base member 1 is roughened. The roughening may be carried out by violently spraying granular material against the surface between the two flanges. Sand or emery steel powder or similar material is blasted onto the surface in order to produce numerous concave and convex portions in a uniform manner over the entire surface of the base member 1. This roughening of the surface allows for a strong adhesion between the surface of the base member and the coating to be applied.

During or after roughening of the surface of the base member 1, the base member is placed within a device which rotates at a fixed, uniform speed. As the base member is being rotated, an extruder 5 is positioned with its end opening in close proximity to the surface of the base 1. An epoxy resin material is then extruded from the extruder 5 onto the surface of the base 1 as the base is being rotated at a uniform speed.

The extruded material has as its main ingredient the epoxy resin but may contain one or more pigment materials. The pigments may be in the form of liquid or powdered paint materials which may be brightly colored. The resin may also contain a powdered metal material such as a powdered aluminum or a powdered shell material, such as powdered pearl or ear shell. The powdered material may be contained within the resin alone or in combination with paint.

A single colored epoxy resin may be applied to the surface of the base 1 or two or more epoxy resins, each having different colors, may be applied simultaneously to the surface of the base 1. FIG. 1 shows the extruder 5 having two outlets making it possible to apply two different colored epoxy resins to the surface of the base 1 simultaneously.

The extruded colored epoxy resin material should be maintained at a temperature above 23° C. in order to prevent it from becoming too viscous. Furthermore, the colored epoxy should be maintained at a temperature below 37° C. so that it does not become excessively fluid. The viscosity range which should be maintained in order to obtain optimum fluidity is 6,500 to 8,000 centipoise (cp).

Figure 2:
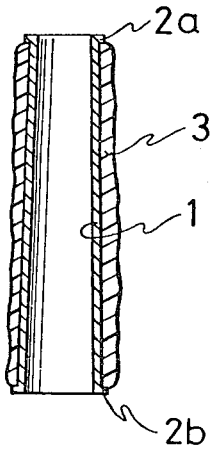
FIG. 2 is a front elevational vertical cross-sectional view after the completion of the coating step.
Figure 3:
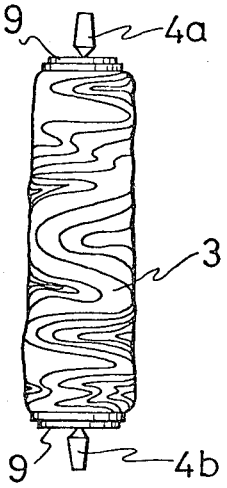
FIG. 3 is a front elevational view of the completely coated article held within a rotational device.

As can be seen within FIGS. 1, 2, and 3, the mixture of epoxy and paint 3 is coated onto the surface 1 so that it bulges outward from the surface beyond the extent of the flanged portions 2*a* and 2*b*. Although the coating should extend outward beyond the extent of the flanged portions on the entire cylinder, care should be taken so as to not apply an excessive amount of coating. The best results are obtained by applying the coating such that it is bulged only slightly beyond the extent of the flanges.

As shown within FIG. 1, the coating is applied by extruding it outwardly from the extruder 5 in the same direction in which the base 1 is rotating. This allows the coating to be applied uniformly onto the base 1.

After the entire surface of the base 1 has been coated, the base may be allowed to continue rotating and the epoxy resin to stabilize and return to room temperature. It may be desirable to subject the coated article to vacuum defoaming at a temperature below 30° C. After the defoaming, the epoxy resin is allowed to stabilize.

The base having the stabilized epoxy resin coating thereon is subjected to a temperature of between 50° C. and 120° C. in order to harden the resin 3.

FIG. 2 shows a cross-section of the article after the resin has been applied and hardened. FIG. 3 shows the coated article within a device which allows for the base to be rotated during the application of the coating and afterwards during the stabilization of a resin. The speed of the rotation may be adjusted in order to create any desired affect with respect to the coating such as a marbeling effect created with two or more different colored resins.

Figure 4:
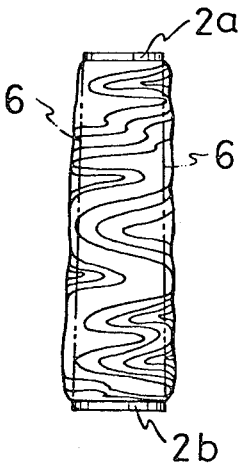
FIG. 4 is a front elevational view of the coated article showing cut-off lines denoting the amount of excess coating to be removed.

After the coating has completely hardened, the article is placed into a device for rotating it such as a lathe. The article is again rotated axially and a cutting mechanism is brought into contact with the outer surface of the coating 3. As shown within FIG. 4, the excess material on the coating 3 beyond the cut-off line 6 is shaved away. Thus, the coating is shaved down to the same level as the outwardly extending flanged portions 2*a* and 2*b*. The coating is thus tightly held against the surface of the base 1 by the epoxy and between the two flanged portions 2*a* and 2*b*. The flanged portions aid in preventing a chipping away of the coating at either end. Due to the structure of the base 1 within the flanged portion and the manner in which the coating is held on the roughened surface of the base 1 between the flanges, the resulting article is extremely durable. Chipping is prevented by the strong adhesion between the epoxy and the roughened surfaces over the majority of the area and is prevented at the end portions by the flanges. Furthermore, the coloring of the coating cannot be removed since it is embedded directly into the epoxy.

After the excess coating has been shaved away to the extent of the cut-off line 6, the surface of the article is polished. The polishing may be carried out within the lathe where the shaving was carried out by applying a buffer to the surface of the article after shaving.

As can be seen within FIG. 3, during the embodiment of the method disclosed above, the rotating mechanism has points of contact at 4*a* and 4*b* which are aligned within the center of the circles formed at the ends of the cylinder 1. However, as shown within FIG. 5, it is possible to position the points of contact 4*a* and 4*b* such that they are not aligned with the center of the circles at either end of the cylinder. The open ends of the cylinder 1 are covered with discs 9 on either end of the cylinder. Therefore, it is possible to position the points of contact 4*a* and 4*b* at any place on the disc 9 in order to achieve different rotational effects.

Figure 5:
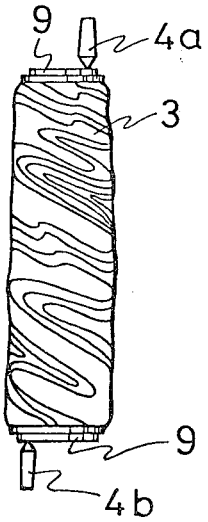
FIG. 5 is a front elevational view of the coated article held within a device for eccentrically rotating it.

When points of contact 4*a* and 4*b* are positioned on the disc 9 in the manner as shown within FIG. 5, an eccentric rotation is accomplished. This type of rotation creates a different marbeling effect than is possible when the rotating mechanisms are positioned such as is shown within FIG. 3. Although such an eccentric rotation may be carried out at any time during the method, it is generally desirable to carry out such an eccentric rotation during the application of the resin to the base 1. If care is taken to apply the coating uniformly to the base 1, the eccentric rotation will not skew the thickness of the coating to an extent which is undesirable.

Figure 6:
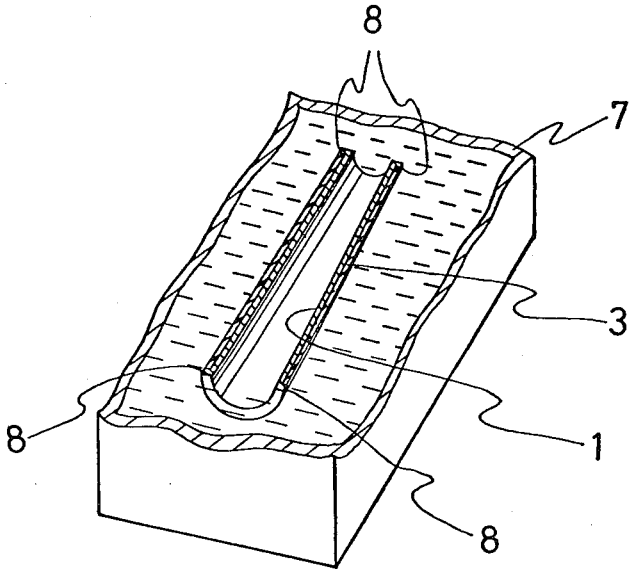
FIG. 6 is a perspective view of a cross-section of the article within an electroplating box.

After the article has been subjected to the shaving process, and/or after shaving and polishing, the article may then be placed within an electroplating box 7, as shown within FIG. 6. An electroplating process is then carried out in order to plate a thin layer of metal onto the outer lip surfaces 8 of the flanged portions 2*a* and 2*b*. Any type of suitable metal may be coated onto these surfaces; such as for example, gold, silver, nickel, or copper.

The instant invention is shown and described herein in what is considered to be the most practical, and the preferred, embodiments. It is recognized, however, that departures may be made therefrom which are within the scope of the invention, and that obvious modifications will occur to one skilled in the art.

I claim:

1. A method for producing a decorative article, comprising the steps of:

(a) forming flange portions on a cylindrical base member wherein said flange portions are positioned at either end of said cylindrical base member and extend outward from an outer surface of said cylindrical base member to form an outer lip surface at each end of said cylinder;

(b) roughening said surface of said cylindrical base member;

(c) rotating said cylindrical member axially;

(d) applying an epoxy resin colored with a pigment to the surface of said cylindrical base member while rotating, wherein an outer surface of said epoxy extends outward from the surface of the cylindrical base member beyond the outer lip surface of the flange portions, said epoxy coating the entire surface of said cylindrical base member;

(e) heating said colored epoxy resin coating to between 23° C. to 37° C. during said applying step while continuing to rotate said cylindrical base member;

(f) continuing to rotate said cylindrical body member until said colored epoxy resin has stabilized and has returned to room temperature;

(g) heating the resulting coated cylindrical body member to a temperature between 50° C. to 120° C. in order to dry said colored epoxy resin;

(h) shaving away said outer surface of said colored epoxy resin to the extent that said outer surface of said epoxy resin extends outward from the surface of said cylindrical base member to the same extent as said outer lip surfaces;

(i) polishing the resulting outer surfaces of said lips and said colored epoxy resin.

2. A method for producing a decorative article, as in claim 1 wherein a plurality of different colored epoxy resins are simultaneously applied to the surface of said cylindrical base member.

3. A method for producing a decorative article, as in any of claims 1 or 2, further comprising the steps of:

electroplating the outer surfaces of said lips.

4. A method for producing a decorative article, comprising the steps of:

(a) forming flange portions on a cylindrical base member wherein said flange portions are positioned at either end of said cylindrical base member and extend outward from an outer surface of said cylindrical base member to form an outer lip surface at each end of said cylinder;

(b) roughening said surface of said cylindrical base member;

(c) rotating said cylindrical member axially;

(d) applying an epoxy resin colored with a pigment to the surface of said cylindrical base member while rotating, wherein an outer surface of said epoxy extends outward from the surface of the cylindrical base member beyond the outer lip surface of the flange portions, said epoxy coating the entire surface of said cylindrical base member;

(e) heating said colored epoxy resin coating to between 23° C. to 37° C. during said applying step while continuing to rotate said cylindrical base member;

(f) continuing to rotate said cylindrical body member until said colored epoxy resin has stabilized and has returned to room temperature;

(g) subjecting said colored epoxy resin coating to vacuum defoaming at a temperature below 30° C.;

(h) continuing to rotate said cylindrical body member while continuing said vacuum defoaming until said colored epoxy resin has stabilized;

(i) heating the resulting coated cylindrical body member to a temperature between 50° C. to 120° C. in order to dry said colored epoxy resin;

(j) shaving away said outer surface of said colored epoxy resin to the extent that said outer surface of said epoxy resin extends outward from the surface of said cylindrical base member to the same extent as said outer lip surfaces;

(k) polishing the resulting outer surfaces of said lips and said colored epoxy resin.

5. A method for producing a decorative article, as in claim 4 wherein a plurality of different colored epoxy resins are simultaneously applied to the surface of said cylindrical base member.

6. A method for producing a decorative article, as in claim 4, further comprising the step of:

electroplating the outer surface of said lips.

7. A method for producing a decorative article as in any of claims 1, 2, 4, or 5 wherein said rotation is an eccentrical rotation.

8. A method for producing a decorative article as in any of claims 1, 2, 4 or 5 wherein said roughening is accomplished by spraying a granular material on the surface of said cylindrical base member.

9. A method for producing a decorative article as in any of claims 1, 2, 4, or 5 wherein said colored epoxy resin contains a material selected from the group consisting of a metal powder, and a shell powder.

* * * * *